US010575666B2

(12) United States Patent
Emmi

(10) Patent No.: US 10,575,666 B2
(45) Date of Patent: Mar. 3, 2020

(54) SALSA CONTAINER ASSEMBLY

(71) Applicant: Ernest Emmi, Palmer, AK (US)

(72) Inventor: Ernest Emmi, Palmer, AK (US)

( * ) Notice: Subject to any disclaimer, the term of this patent is extended or adjusted under 35 U.S.C. 154(b) by 51 days.

(21) Appl. No.: 15/865,301

(22) Filed: Jan. 9, 2018

(65) Prior Publication Data

US 2019/0208937 A1 Jul. 11, 2019

(51) Int. Cl.
*A47G 19/02* (2006.01)
*B65D 85/72* (2006.01)
*B65D 43/02* (2006.01)

(52) U.S. Cl.
CPC ..... *A47G 19/02* (2013.01); *B65D 43/0202* (2013.01); *B65D 85/72* (2013.01); *A47G 2400/06* (2013.01)

(58) Field of Classification Search
CPC ..... A47G 19/02; A47G 2400/06; B65D 43/0202; B65D 85/72; B65D 51/246; B65D 3/00; B65D 43/02; B65D 21/00; B65D 21/02; B65D 17/34; G01F 19/00; A47J 47/00; A47J 47/04; A47J 47/02
USPC ..... 220/574.1, 575, 574, 698, 695, 657
See application file for complete search history.

(56) References Cited

U.S. PATENT DOCUMENTS 2,151,895 A 3/1939 Carlson
3,688,943 A 9/1972 Brown
D409,448 S 5/1999 Hudson, Jr.
6,293,692 B1 * 9/2001 Bowsher ..... B44D 3/12 220/698
7,428,977 B2 9/2008 Fers
7,549,540 B2 * 6/2009 Lee ..... B65D 21/0219 206/519
8,002,140 B2 8/2011 Schantz
8,342,359 B2 1/2013 Cannon, III
8,413,837 B2 4/2013 Bollengier
8,870,021 B2 * 10/2014 Smyers ..... A47G 19/02 220/326
2007/0059461 A1 3/2007 Carr
2009/0218360 A1 * 9/2009 Suk ..... B65D 43/0212 220/784
2014/0097183 A1 * 4/2014 McGrath ..... B65D 25/2897 220/212

FOREIGN PATENT DOCUMENTS

CN 207370453 U * 4/2017 ..... A47G 19/02
WO WO2008125978 10/2008

OTHER PUBLICATIONS

Translation of CN207370453, Xu, May 18, 2018, pp. 1 and 7 (Year: 2018).*

* cited by examiner

*Primary Examiner* — Robert J Hicks

(57) ABSTRACT

A salsa container assembly for facilitating salsa to be retained on a chip includes a bowl that may contain a fluid food item. A lip is positioned in the bowl to facilitate the fluid food item to be scooped onto a chip for eating. A lid is removably coupled to the bowl such that the lid closes the bowl.

5 Claims, 4 Drawing Sheets

SALSA CONTAINER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to container devices and more particularly pertains to a new container device for facilitating salsa to be retained on a chip.

BRIEF SUMMARY OF THE INVENTION

An embodiment of the disclosure meets the needs presented above by generally comprising a bowl that may contain a fluid food item. A lip is positioned in the bowl to facilitate the fluid food item to be scooped onto a chip for eating. A lid is removably coupled to the bowl such that the lid closes the bowl.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
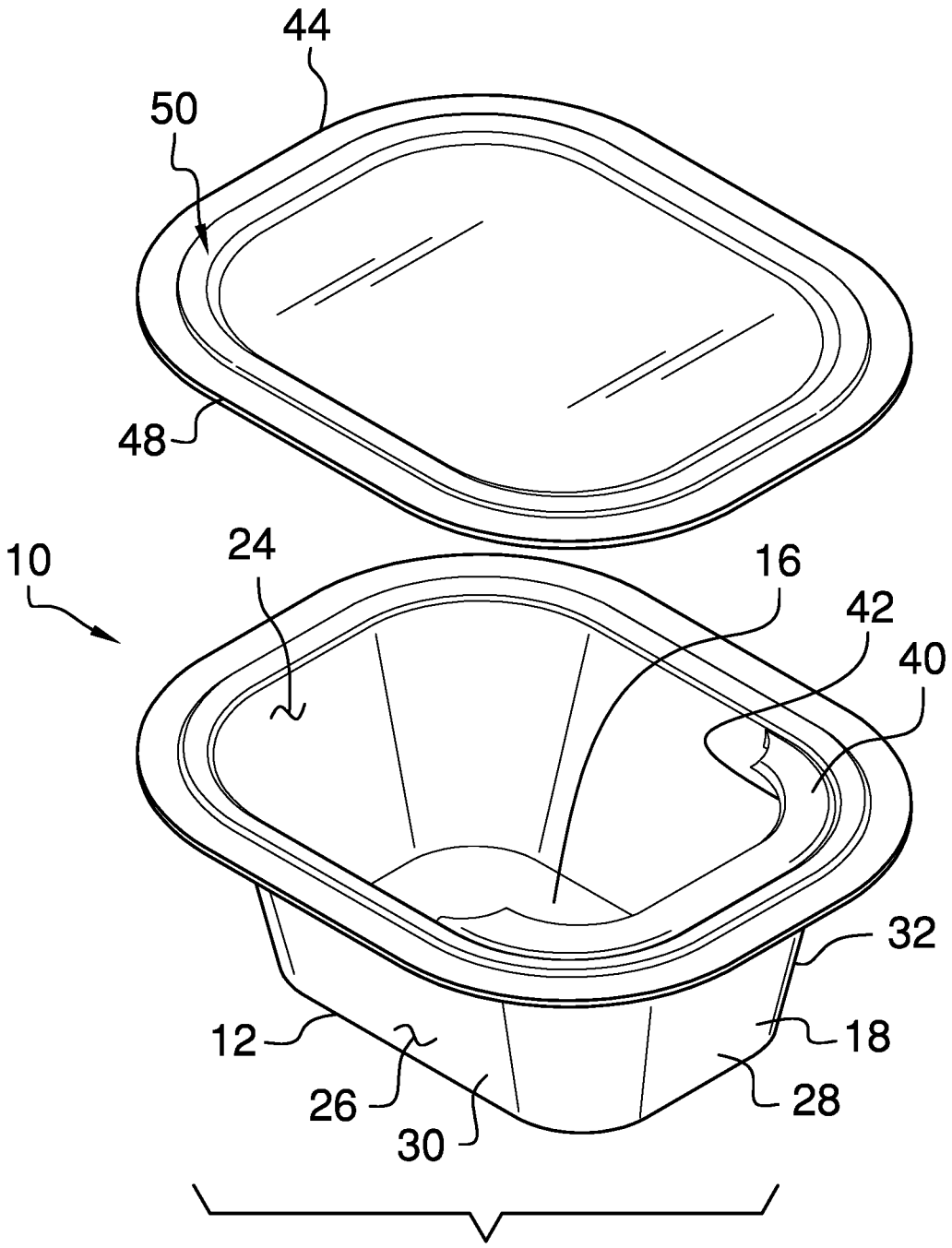
FIG. 1 is an exploded perspective view of a salsa container assembly according to an embodiment of the disclosure.
Figure 2:
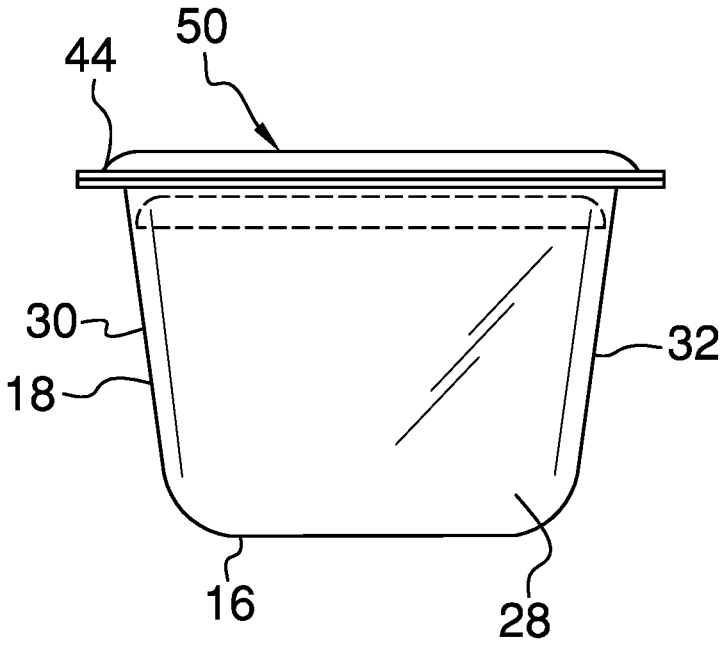
FIG. 2 is a front phantom view of an embodiment of the disclosure.
Figure 3:
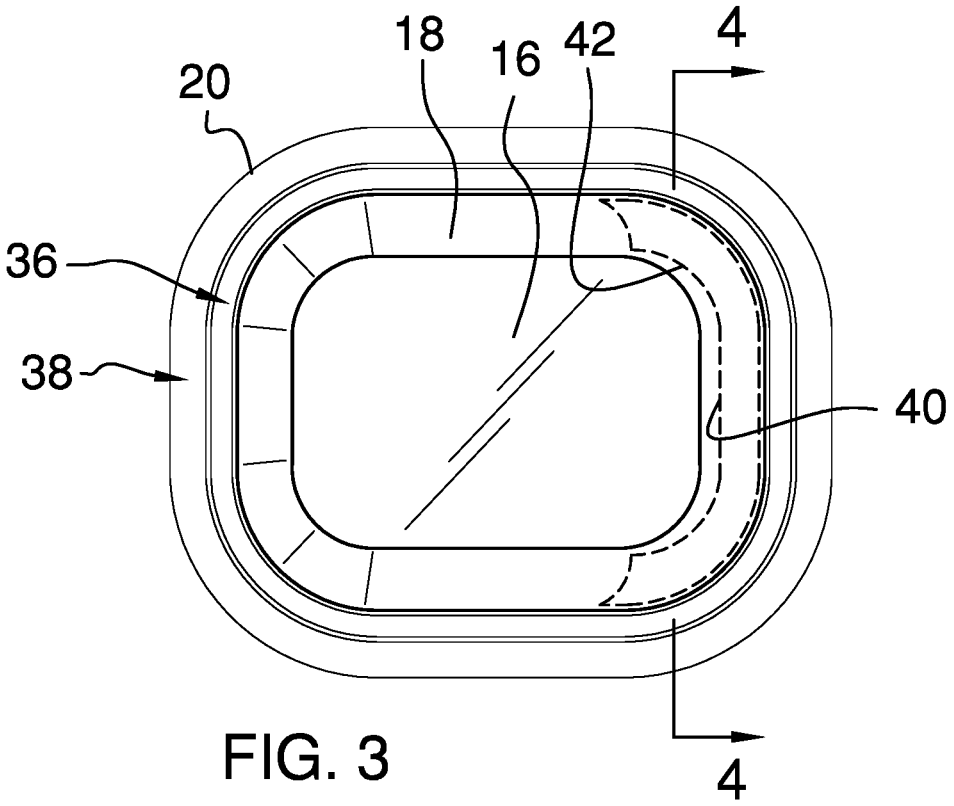
FIG. 3 is a bottom phantom view of an embodiment of the disclosure.
Figure 4:
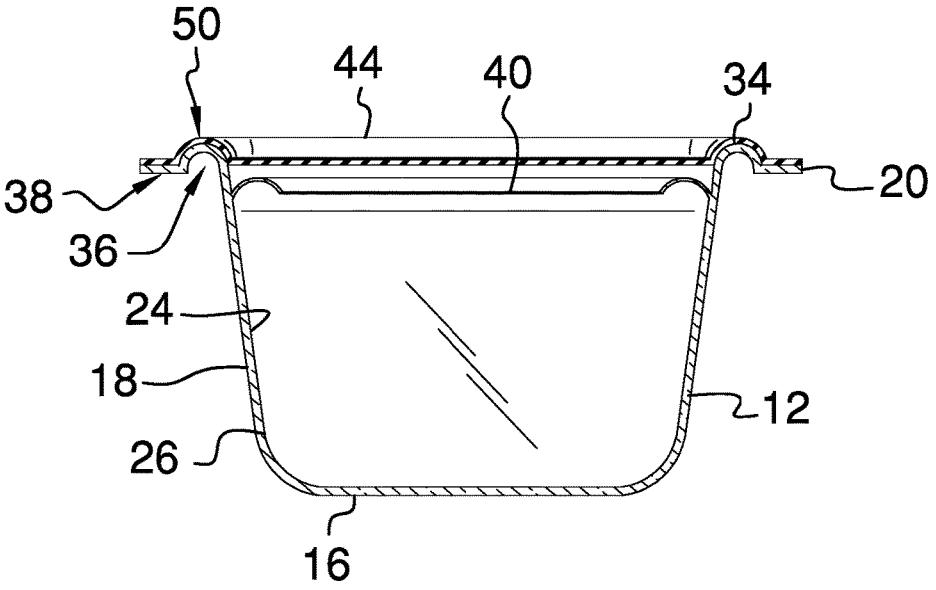
FIG. 4 is a cross sectional view taken along line 4-4 of FIG. 3 of an embodiment of the disclosure.
Figure 5:
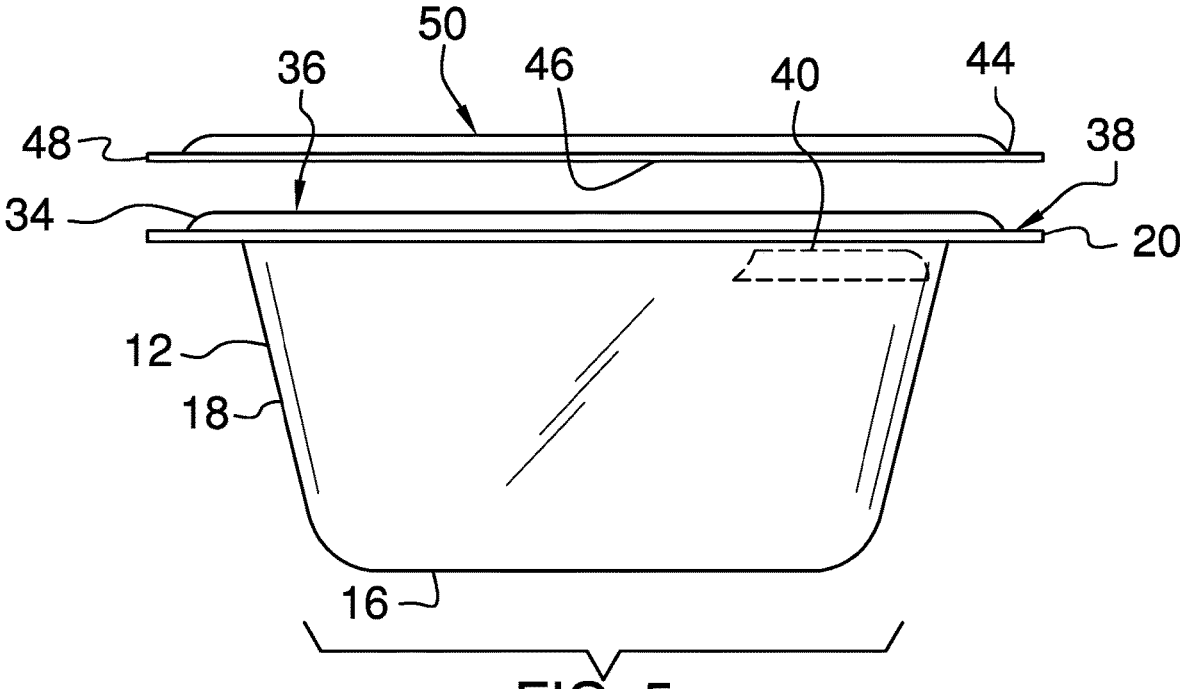
FIG. 5 is a right side phantom view of an embodiment of the disclosure.
Figure 6:
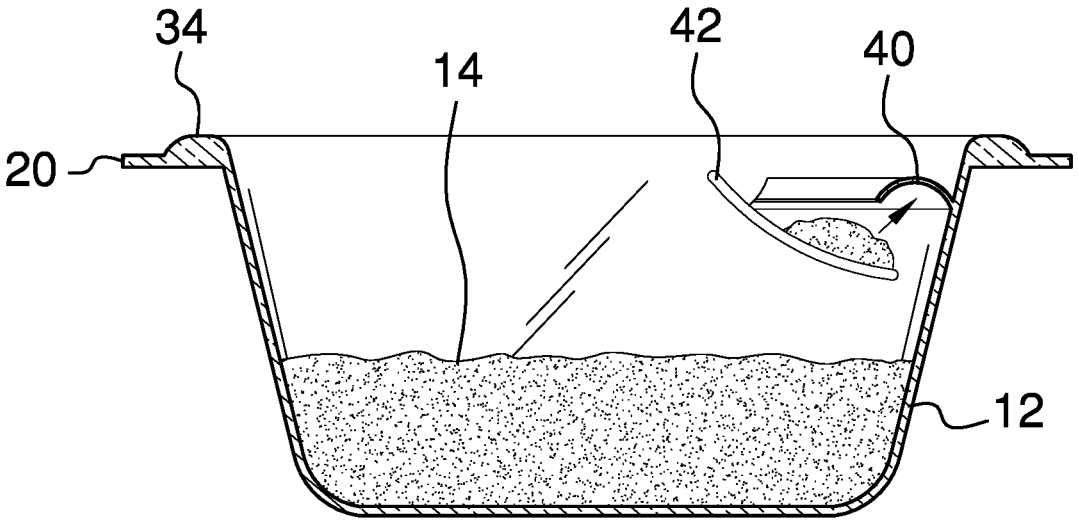
FIG. 6 is a perspective in-use view of an embodiment of the disclosure.

With reference now to the drawings, and in particular to FIGS. 1 through 6 thereof, a new container device embodying the principles and concepts of an embodiment of the disclosure and generally designated by the reference numeral 10 will be described.

As best illustrated in FIGS. 1 through 6, the salsa container assembly 10 generally comprises a bowl 12 that may contain a fluid food item 14. The bowl 12 has a bottom wall 16 and an outer wall 18 extending upwardly therefrom. Additionally, the outer wall 18 has a distal edge 20 with respect to the bottom wall 16 to define an opening 22 into the bowl 12. The outer wall 18 has an inner surface 24 and an outer surface 26. The bowl 12 may have a front side 28, a first lateral side 30 and a second lateral side 32 such that the bowl 12 has a rectangular shape. Alternatively, the outer wall 18 may be continuous such that the bowl 12 has a circular shape.

The outer wall 18 has a bend 34 thereon such that the distal edge 20 of the outer wall 18 is directed laterally away from the outer wall 18. The bend 34 defines a concavely arcuate portion 36 of the outer wall 18. Additionally, the outer wall 18 has a flattened portion 38 extending between the bend 34 and the distal edge of the outer wall 18. The flattened portion 38 is horizontally oriented.

A lip 40 is positioned in the bowl 12 and the lip 40 facilitates the fluid food item 14 to be scooped onto a chip 42 for eating. The fluid food item 14 may be salsa or the like and the chip 42 may be a tortilla chip 42 or the like. The chip 42 is dipped into the fluid food item 14 and the chip 42 is scraped against the lip 40. In this way the lip 40 facilitates the salsa to remain on the chip 42 when the chip 42 is removed from the bowl 12.

The lip 40 is positioned on the inner surface 24 of the outer wall 18 and the lip 40 is horizontally oriented on the bowl 12. The lip 40 has a distal edge 42 with respect to the inner surface 24. Additionally, the lip 40 is concavely arcuate between the inner surface 24 and the distal edge 42 of the lip 40. The lip 40 extends along the front side 28 and partially along each of the first lateral side 30 and the second lateral side 32.

A lid 44 is removably coupled to the bowl 12 such that the lid 44 closes the bowl 12. The lid 44 has a first surface 46 and a perimeter edge 48 and the lid 44 has a concavely arcuate portion 50 with respect to the first surface 46. The concavely arcuate portion 50 of the lid 44 is spaced from the perimeter edge 48 and the concavely arcuate portion 50 of the lid 44 is coextensive with the perimeter edge 48. The concavely arcuate portion 50 of the lid engages the bend 34 on the outer wall 18 of the bowl 12. Moreover, the concavely arcuate portion 50 of the lid 44 forms a fluid impermeable seal with the bend 34 to inhibit the fluid food item 14 from escaping the bowl 12.

In use, the fluid food item 14 is poured into the bowl 12. The chip 42 is manipulated to dip the chip 42 into the fluid food item 14. Additionally, the chip 42 is positioned against the lip 40 when the chip 42 is removed from the bowl 12. In this way the lip 40 inhibits the fluid food item 14 from falling off of the chip 42 when the chip 42 is removed from the bowl 12. Thus, the chip 42 may be consumed with the fluid food item 14 positioned on the chip 42. The lid 44 is selectively positioned on the bowl 12 to retain freshness of the fluid food item 14 in the bowl 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A salsa container assembly being configured to facilitate salsa to be scooped onto a chip, said assembly comprising:

a bowl being configured to contain a fluid food item, said bowl having a bottom wall and an outer wall extending upwardly therefrom, said outer wall having a distal edge with respect to said bottom wall to define an opening into said bowl, said outer wall having an inner surface and an outer surface, said outer wall having a front side, a first lateral side and a second lateral side, said outer wall having a bend thereon such that said distal edge of said outer wall is directed laterally away from said outer wall;

a lip being positioned in said bowl wherein said lip is configured to facilitate the fluid food item to be scooped onto a chip for eating, said lip being positioned on said inner surface of said outer wall, said lip being horizontally oriented on said bowl, said lip having a distal edge with respect to said inner surface, a bottom surface of said lip being concavely arcuate between said inner surface and said distal edge of said lip, said lip extending along said front side and partially along each of said first lateral side and said second lateral side; and a lid being removably coupled to said bowl such that said lid closes said bowl.

2. The assembly according to claim 1, wherein said bend defines a concavely arcuate portion of said outer wall, said outer wall having a flattened portion extending between said bend and said distal edge of said outer wall, said flattened portion being horizontally oriented.

3. The assembly according to claim 2, wherein said lid has a first surface and a perimeter edge, said lid having a concavely arcuate portion with respect to said first surface, said concavely arcuate portion being spaced from said perimeter edge, said concavely arcuate portion being coextensive with said perimeter edge.

4. The assembly according to claim 3, wherein said concavely arcuate portion engages said bend on said outer wall of said bowl such that said concavely arcuate portion forms a fluid impermeable seal with said bend wherein said lid is configured to inhibit the fluid food item from escaping said bowl.

5. A salsa container assembly being configured to facilitate salsa to be scooped onto a chip, said assembly comprising:

a bowl being configured to contain a fluid food item, said bowl having a bottom wall and an outer wall extending upwardly therefrom, said outer wall having a distal edge with respect to said bottom wall to define an opening into said bowl, said outer wall having an inner surface and an outer surface, said outer wall having a front side, a first lateral side and a second lateral side, said outer wall having a bend thereon such that said distal edge of said outer wall is directed laterally away from said outer wall, said bend defining a concavely arcuate portion of said outer wall, said outer wall having a flattened portion extending between said bend and said distal edge of said outer wall, said flattened portion being horizontally oriented;

a lip being positioned in said bowl wherein said lip is configured to facilitate the fluid food item to be scooped onto a chip for eating, said lip being positioned on said inner surface of said outer wall, said lip being horizontally oriented on said bowl, said lip having a distal edge with respect to said inner surface, a bottom surface of said lip being concavely arcuate between said inner surface and said distal edge of said lip, said lip extending along said front side and partially along each of said first lateral side and said second lateral side; and a lid being removably coupled to said bowl such that said lid closes said bowl, said lid having a first surface and a perimeter edge, said lid having a concavely arcuate portion with respect to said first surface, said concavely arcuate portion being spaced from said perimeter edge, said concavely arcuate portion being coextensive with said perimeter edge, said concavely arcuate portion engaging said bend on said outer wall of said bowl such that said concavely arcuate portion forms a fluid impermeable seal with said bend wherein said lid is configured to inhibit the fluid food item from escaping said bowl.

* * * * *